United States Patent [19]

On

[11] 4,203,550

[45] May 20, 1980

[54] SHOWER HEADS

[75] Inventor: Lo Hou On, Kowloon, Hong Kong

[73] Assignee: Hexagear Industries Limited, Shaukiwan, Hong Kong

[21] Appl. No.: 857,698

[22] Filed: Dec. 5, 1977

[30] Foreign Application Priority Data

Dec. 6, 1976 [GB] United Kingdom ..... 50781/76

[51] Int. Cl.[2] ..... B05B 1/08

[52] U.S. Cl. ..... 239/102; 239/447; 239/449

[58] Field of Search ..... 239/101, 102, 394, 444, 239/449

[56] References Cited

U.S. PATENT DOCUMENTS

| | | | |
|---|---|---|---|
| 3,958,756 | 5/1976 | Trenary et al. | 239/383 |
| 3,963,179 | 6/1976 | Tomaro | 239/449 X |
| 3,998,390 | 12/1976 | Peterson et al. | 239/394 |
| 4,068,801 | 1/1978 | Leutheuser | 239/394 X |
| 4,081,135 | 3/1978 | Tomaro | 239/449 X |

FOREIGN PATENT DOCUMENTS

| | | | |
|---|---|---|---|
| 1490836 | 11/1977 | United Kingdom | 239/101 |

*Primary Examiner*—Robert B. Reeves
*Assistant Examiner*—Gene A. Church
*Attorney, Agent, or Firm*—Price, Heneveld, Huizenga & Cooper

[57] ABSTRACT

A shower head comprises a water chamber and attachment means for connecting the water chamber to a water conduit. A rotor in the water chamber is rotated by swirling motion of the water and causes pulsating emission of water from holes in an end face of the water chamber. A movably mounted outer casing has windows formed therein to allow the pulsating emission through. Changing the position of the outer casing causes water to be emitted continuously from holes formed in the outer casing and sealed from the windows.

1 Claim, 8 Drawing Figures

SHOWER HEADS

FIELD OF THE INVENTION

The present invention relates to shower heads. Such shower heads may be used in shower baths or as hand-held sprays.

SUMMARY OF THE INVENTION

According to the invention, there is provided a shower head comprising means for attachment to a fluid conduit, a fluid chamber fixed to the attachment means and arranged to receive fluid via the attachment means, and an outer casing movably mounted with respect to the fluid chamber and arranged to change the emission of fluid from the shower head according to its position with respect to the fluid chamber between continuing and pulsating emission.

DESCRIPTION OF THE EMBODIMENTS

Figure 1:
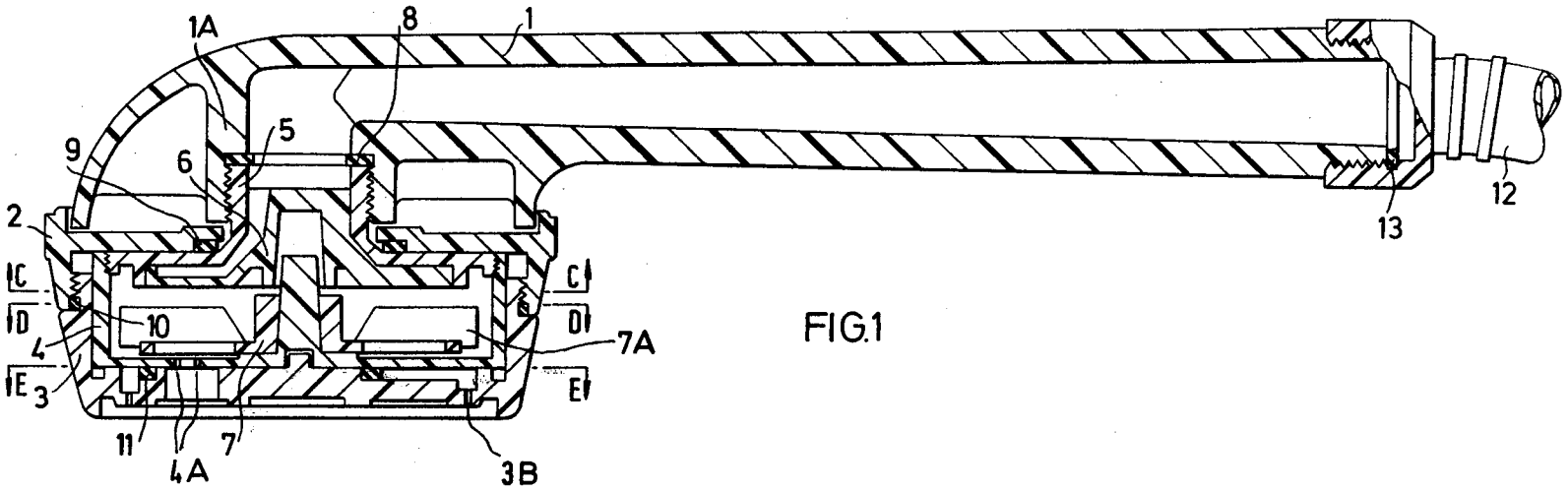
FIG. 1 is a vertical cross-section of a preferred hand-held shower head.
Figure 2:
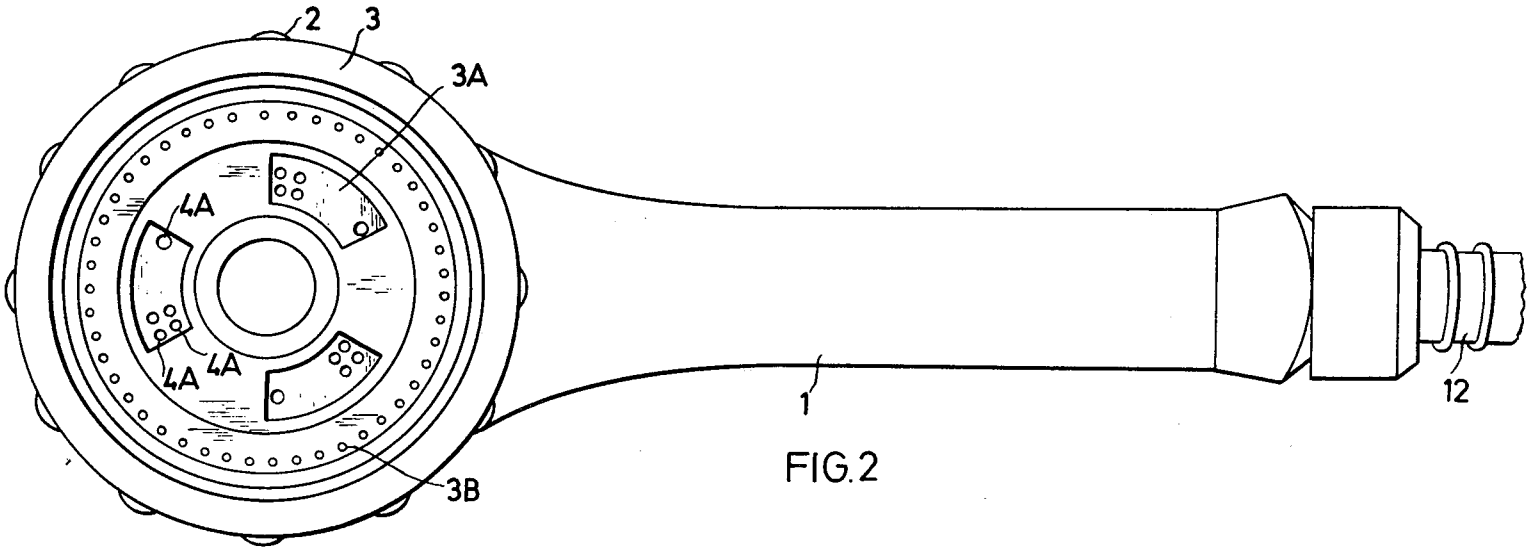
FIG. 2 is a view from below the shower head of FIG. 1.
Figure 3:
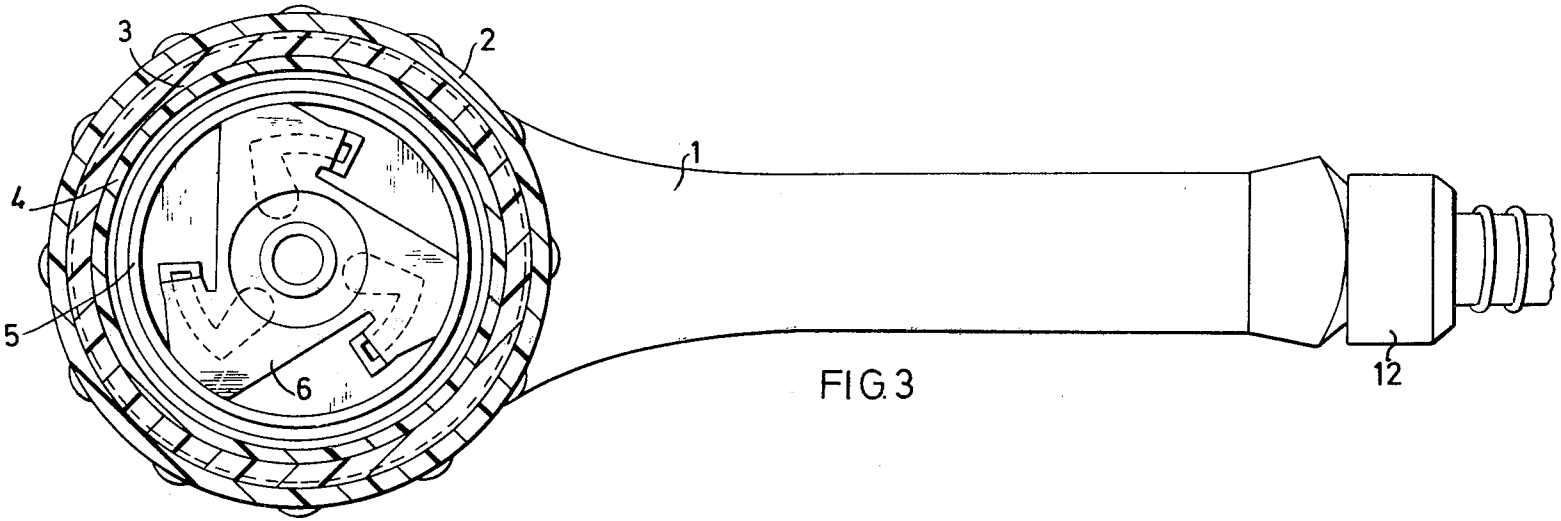
FIG. 3 is a cross-sectional view taken on the line C—C of FIG. 1.
Figure 5:
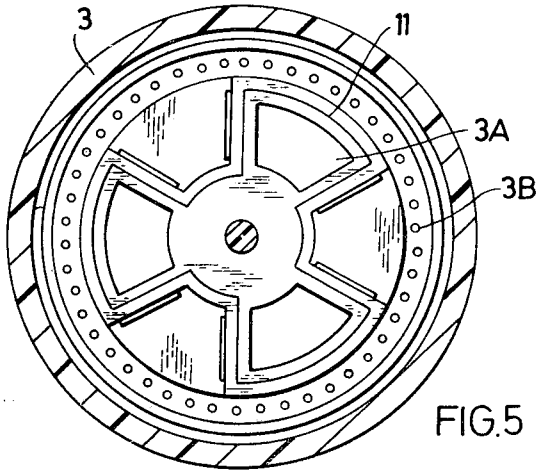
FIG. 5 is a cross-sectional view taken on the line E—E of FIG. 1.
Figure 4:
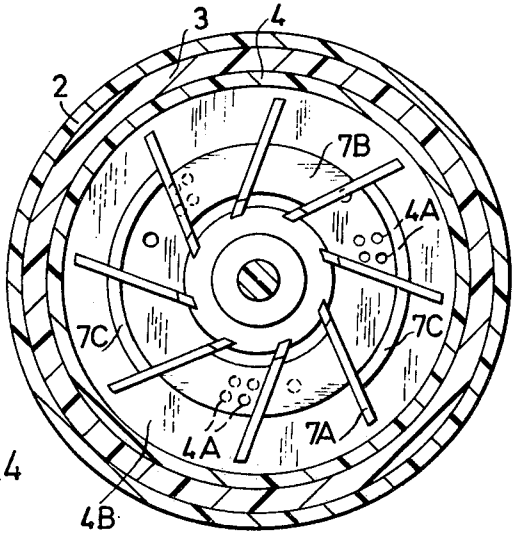
FIG. 4 is a cross-sectional view taken on the line D—D of FIG. 1.
Figure 6:
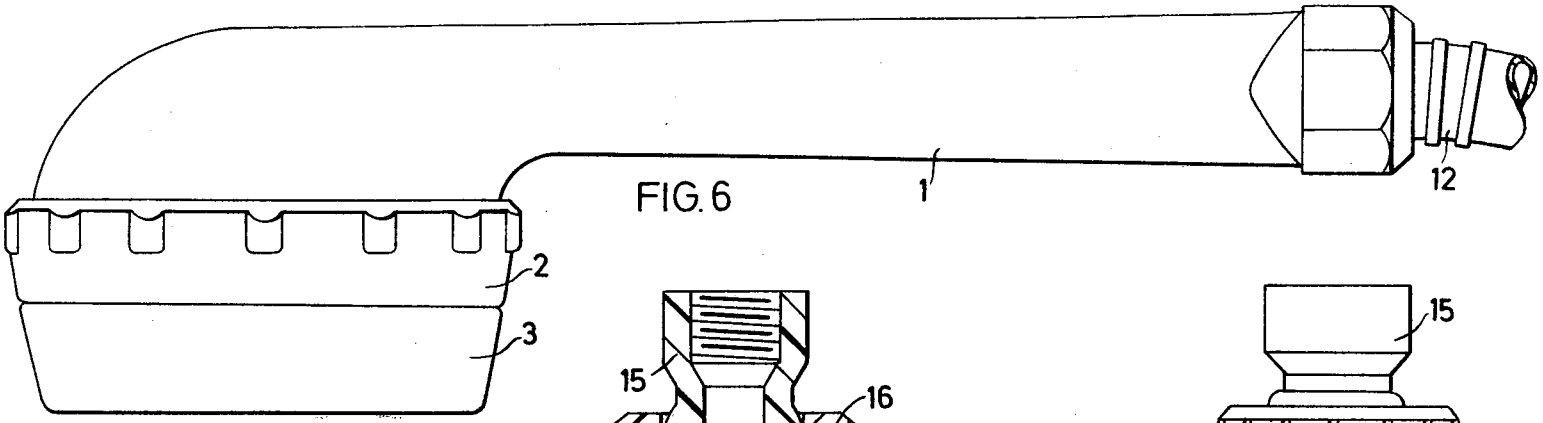
FIG. 6 is a side view of the shower head of FIG. 1.

The hand-held shower head shown in the drawings comprises a handle 1 formed as a hollow tube. At one of its ends, the handle is fixed, for instance by gluing or screwthreading, to a flexible water hose 12, a gasket 13 being provided between the handle 1 and the hose 12 so as to provide a water tight seal.

The other end of the handle extends generally perpendicularly to the centre portion thereof and has a greatly increased cross-sectional area with respect thereto. The tube formed within the hollow handle 1 communicating with the interior of the hose 12 also extends perpendicularly to the centre portion of the handle inside a cylindrical portion 1A. A cover 5 of a water chamber 4 enclosed within the shower head is screwed into the cylindrical portion 1A and provided with a synthetic rubber washer 8 to provide a water tight seal. The cover 5 and water chamber 4 constitutes a housing. A water flow converter-accelerator 6 is fixed to the cover 5. The water flow converter-accelerator 6 is formed with passageways arranged to direct water flowing in through the handle 1 towards the periphery of the water chamber 4 and then tangentially with respect thereto and to increase the speed of flow of the water, so as to provide a strong whirling motion of the water.

The water chamber 4 is formed with a central stub-axle portion over which is rotatably mounted on a rotor valve 7. The rotor valve 7 is provided with a plurality of vanes 7A, eight being shown in the preferred shower head. The rotor valve 7 is thus arranged to be rotated under the action of the strong whirling motion of the water in the water chamber 4. The rotor valve 7 further includes two base portions 7B, arranged to intermittently obscure one or more groups of holes 4A provided in a bottom plate 4B of the water chamber 4 and to support, together with another two base portions 7C, the vanes 7A. The centre part of the bottom plate 4B is raised slightly so as to reduce friction between the rotor valve 7 and the bottom plate 4B.

A lower casing member 3 has an end panel which is provided with three windows 3A and with a plurality of small holes 3B arranged in a circle enclosing the three windows. A special shaped gasket 11 is provided to cooperate with the lower casing member 3 and the bottom plate 4B so as to seal the windows 3A from the lower case member 3 and the small holes 3B.

The lower casing member 3 is fixed to an upper casing member 2 which is mounted for rotation about the water chamber 4 by means of a flange seating over the cover 5. The upper and lower casing members 2 and 3 together form an exterior shell. The upper casing member 2 is provided with a corrugated rim to facilitate its rotation by hand. A further washer 10 is provided between the upper casing member 2 and the lower casing member 3 so as to provide a water tight seal. A further washer 9 is provided between the upper casing member 2 and the water chamber cover 5 to provide a water tight seal. The windows 3A in the lower casing member 3 are arranged such that they can be brought into registration with all three groups of holes 4A simultaneously by rotating the lower casing member 3 to a suitable position.

In use, water is supplied to the interior of the handle 1 through the hose 12. The water is then directed into the water chamber 4 via three channels provided on the water flow converter-accelerator 6. The water enters the water chamber 4 with a swirling motion and acts against the vanes 7A so as to cause the rotor valve 7 to rotate. Assuming that the lower casing member 3 has been rotated so that the windows 3A are in registration with the groups of holes 4A, the base portions 7B of the rotor valve uncover in sequence each group of the holes 4A, one or more of these groups being uncovered at any given time. Water is thus ejected through at least one of the three groups of holes in turn to provide a pulsating spray action.

If the lower casing member 3 is rotated so that the windows 3A are brought into registration with parts of the bottom plate 4B not provided with holes in registration therewith, water is forced through the uncovered group or groups of holes 4A into the space between the lower casing member 3 and the bottom plate 4B sealed from the windows 3A by the special gasket 11 and communicating with the small holes 3B. Thus, a substantially continuous spray of water is emitted from the small holes 3B.

If desired, the lower casing member 3 can be rotated to a position in which some of the holes 4A communicate with the windows 3A and others of the holes 4A communicate with the small holes 3B. A mixture of pulsating spray and constant spray is then obtained.

The pulsating or intermittent spray can be used to produce a massage effect.

Figure 8:
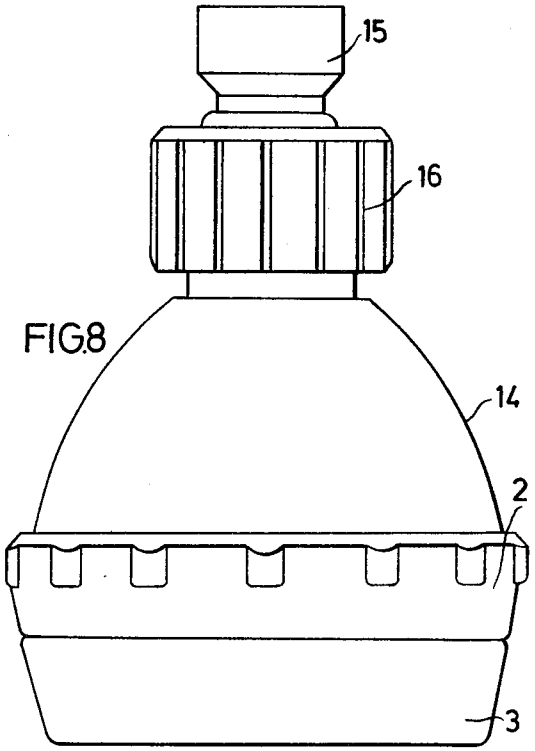
FIG. 8 is a side view of the shower head of FIG. 6.
Figure 7:
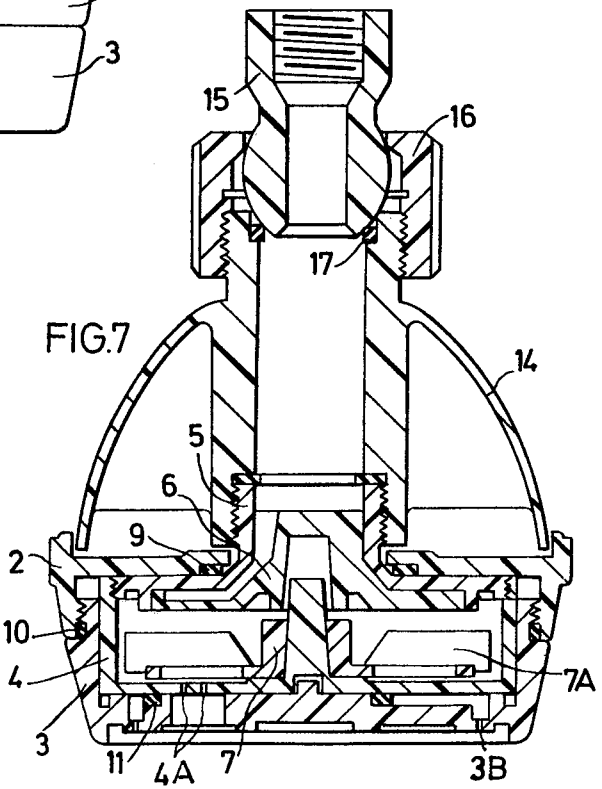
FIG. 7 is a vertical cross-section of a preferred wall mounted shower head.

FIGS. 7 and 8 show a preferred wall mounted shower head, with like reference numerals referring to like parts as in the other drawings. The wall mounted shower head is provided with a bell shaped cover 14 in place of the tubular handle of the hand-held shower head. Also, a ball joint 15 and 16 is provided between the water hose and the bell shaped cover 14. Otherwise, the construction and operation of the shower head shown in FIGS. 7 and 8 are the same as those of the shower head shown in the remainder of the figures.

The preferred shower heads have a very simple construction and require very few separate parts. A reason for this is the use of a self contained water chamber in which the only moving part is the rotor valve 7. The water flow converter-accelerator 6 can be glued into position on the cover 5. An efficient seal may thus be provided which is not affected by rotation or twisting of the outer casing to change the type of spray produced.

Various modifications may be made within the scope of the invention. For instance, although three groups of five holes 4A have been shown, together with three windows 3A, the number of holes in each group and the number of groups and windows may be changed to produce the desired pulsating spray effect. Also, the lower casing member 3 may be glued to the upper casing member 2.

I claim:

1. A shower head having a hollow casing defining a fluid supply conduit; a circular housing having first and second end walls and an annular peripheral wall forming a fluid chamber; said housing having a fluid inlet port in said first end wall communicating with said supply conduit and secured to said casing; a rotor rotatably mounted in said chamber; said rotor having vanes thereon for impelling said rotor from fluid moving through said chamber; said second end wall having first fluid discharge openings therethrough arranged in circumferentially spaced groups and second fluid discharge openings circumferentially spaced from said first openings; said rotor having a base panel adjacent and generally parallel to said second end wall; said base panel having an opening therethrough arranged radially to overlap both said first and second discharge openings; an outer shell having inner and outer portions, the outer portion being cup-like and rotatable about said housing and having a front panel equipped with circumferentially spaced radially inner openings and a plurality of radially outer openings; said inner openings being radially aligned with said openings in said second end wall; means on the inner face of said front panel surrounding each of said inner openings and forming a seal therearound to create a fluid passageway between said inner openings and said first openings in said base panel when said shell is in one circumferential position and to close said first openings when said shell is in a second circumferential position; a chamber between said front panel and said second end wall surrounding said means and forming a chamber communicating with said radially outer openings and with said second openings when said shell is in said second position to redirect fluid to said second openings only; said outer and inner portions of said shell being threadedly joined together; means providing a liquid tight seal between said portions; said inner portion having a radially inwardly extending flange adjacent the inner face of said first end wall of said housing and providing said rotatable mounting of said outer shell on said housing; a seal seated between said flange and the inner face of said first end wall; said outer and inner portions entirely enclosing said housing and providing a circular grip for adjusting the operational characteristics of said shower head.

* * * * *